United States Patent [19]

Zeitz

[11] Patent Number: 4,479,759

[45] Date of Patent: Oct. 30, 1984

[54] VALVELESS, POSITIVE DISPLACEMENT PUMP

[76] Inventor: Vernon Zeitz, 4 Plain Hill Rd., Springfield, Vt. 05156

[21] Appl. No.: 377,750

[22] Filed: May 13, 1982

Related U.S. Application Data

[63] Continuation of Ser. No. 103,036, Dec. 13, 1979, abandoned.

[51] Int. Cl.[3] ..... F04B 7/06

[52] U.S. Cl. ..... 417/500

[58] Field of Search ..... 417/492, 500; 92/33; 123/45 A

[56] References Cited

U.S. PATENT DOCUMENTS

| | | | |
|---|---|---|---|
| 837,905 | 12/1906 | Knott | 184/33 |
| 857,221 | 6/1907 | Anderson et al. | 417/500 X |
| 2,451,390 | 10/1948 | Humphreys | 417/500 X |
| 2,576,175 | 11/1951 | Esley | 417/500 |
| 3,930,762 | 1/1976 | Varga | 417/492 |
| 3,981,688 | 9/1976 | Telang et al. | 418/178 X |
| 3,994,632 | 11/1976 | Schreiber | 123/45 A X |
| 4,180,028 | 12/1979 | Richter | 123/45 A |

FOREIGN PATENT DOCUMENTS

| | | | |
|---|---|---|---|
| 498320 | 5/1930 | Fed. Rep. of Germany | 184/33 |

*Primary Examiner*—Leonard E. Smith

*Attorney, Agent, or Firm*—John J. Simkanich

[57] ABSTRACT

A pump may be provided for valveless, positive-displacement, rotary operation having at least one piston operating within a cylinder and preferably describing a complex motion including both reciprocating and rotary motions whereby vacuum and pressure forces may be alternately created at ports into the cylinder.

6 Claims, 11 Drawing Figures

VALVELESS, POSITIVE DISPLACEMENT PUMP

This is a continuation of application Ser. No. 103,036, filed Dec. 13, 1979, now abandoned.

BACKGROUND OF THE INVENTION

This invention relates to industrial and scientific pumps for pumping fluids, both liquids and gases, in very precise quantities or at very precise rates. More specifically it relates to valveless pumps where the "plug" volume remains constant and is repetitiously so at all speeds.

Prior art pumps have been designed, principally, according to one of two design criteria, reciprocating motion or rotary motion. Reciprocating pumps have incorporated a piston which operates within a cylinder. This piston has been driven off of a cam shaft or similar means to more reciprocatingly within the cylinder, the stroke displacement defining the volume of each "plug" of fluid moved through the pump.

While pumps may seem to operate continuously, when examined microscopically, they can be seen to cause discrete, contiguous volumes of "plugs" of fluid to move through the pump for each cycle of operation thereof. With critical applications a pump need to provide a precise discharge (output) pressure which is equivalent to saying it must pump repeatedly uniform plugs of the fluid and controlably variable speeds.

Reciprocating pumps utilize intake and exhaust valves. These valves present opportunities for leakage which may vary according to wear, pump size and speed of operation. This leakage is created when some of the fluid slips back or leaks and is not pumped along. In order to maintain more precise volume or rate pumping, a smaller reciprocating pump will be used which will have to be run at higher speeds for capacity. But higher speeds contribute to valve leakage as the valves are separate from the piston and cannot be precisely timed coordinately to piston operation at all speeds. While piston retreat causes the pump intake side to see an increasing chamber volume and to experience a vacuum during the intake operation; and piston advance causes the pump discharge side to see a decreasing chamber volume and experience a pressure during the exhaust operation, valve operation not absolutely precise. The piston stroke, therefore, does not precisely define "plug" size at all speeds, and in fact actual pumped plug size varies non-linearly with speed.

Rotary pumps have incorporated various devices to rotate within a housing creating a suction on one side (the intake) and a pressure on the other side (the discharge). Such devices include rotating eccentric pistons, rotating lobes, rotating vanes, rotating gears, rotating screws and rotating impellers. Rotary pumps essentially "scoop along" quantities of fluid causing a cavity which draws in more fluid to the intake location. Rotary pumps can be run at higher speeds than reciprocating pumps with less vibration but are subject to leakages, i.e., slippage.

Rotary pumps do not present a changing potential cylinder volume which causes a vacuum or void to draw in the fluid like a reciprocating pump. They present a fixed "scoop volume" which rotates around in and are causing a vacuum along the leading surface of the scoop and a pressure force along the trailing surface of the scoop. This pressure force tends to push fluid back out the intake causing slippage or leakage. While at the discharge side of a rotary pump the vacuum edge tends to drag fluid around again, away from the discharge. The performance characteristics (efficiency) including pumping rate of rotary pumps varies with speed.

Pinkerton, U.S. Pat. No. 3,257,953, has taught an alternative to reciprocating pumps and rotary pumps. The Pinkerton pump has a piston which oscillates back and forth through a defined angle while it also reciprocates. A complicated cam, lever and guide drive mechanism controls the operation of the Pinkerton piston. The Pinkerton pump can be characterized as a compound reciprocating pump whereby its piston reciprocates along the longitudinal axis of the cylinder while also reciprocating about an arc. Pinkerton has a second U.S. Pat. No. 3,168,872 patent.

What is desired, however, is a pump which provides the advantages of smooth high speed operation present with a rotary pump without the rotary pump disadvantage of fluid slip and which provides the advantages of positive displacement present in a reciprocating pump without the valve operation disadvantages.

An objective of this invention is to provide a pump which provides a positive displacement pumping operation without the use of valves.

A second objective of this invention is to have this valveless positive displacement pump operate with rotary motion.

A further objective of this invention is to provide this pump with a piston operating within a cylinder, this piston undergoing reciprocating motion as well as rotary motion.

An even further objective of this invention is to have this pump piston undergo a sinusoidal motion.

SUMMARY OF THE INVENTION

The objectives of this invention are realized in a valveless, positive-displacement, rotary pump. A piston operates within a cylinder under reciprocating and rotary motion. A notch or other cavity in the face of the piston defines a part of a positive displacement volume and is caused to pass a plurality of ports through the cylinder wall while the piston is either receeding from or advancing toward the head of the cylinder to create either a vacuum or pressure force upon respective ports.

The piston may be coupled to a drive shaft/arm which may include a slip type drive coupling allowing for a longitudinal reciprocation of the cylinder and drive shaft while they are rotationally driven.

A sinusoidal cam track may control the position of the piston within the cylinder as the piston is caused to rotate within the cylinder. The nulls of the sinusoidal cam track may be positioned in a distinct relationship to the ports to "time" the intake and exhaust function of the pump.

When a plurality of designated intake and discharge ports are positioned about the cylinder and a corresponding plural sinusoidal cam track (race) is used the pump will provide a plurality of pumping strokes per single revolution.

DESCRIPTION OF THE DRAWINGS

The advantages, structural features and operation of the invention can easily be understood from a reading of the following detailed description of the invention in conjunction with the attached drawings in which like numerals refer to like elements and in which.

DETAILED DESCRIPTION OF THE INVENTION

A valveless, positive displacement pump is constructed to operate in a rotary manner so that it may be driven directly off of a rotary power source such as an electric motor. This pump includes a piston continuously rotating within a cylinder, while also reciprocating back and forth between two limits of movement, so that the resultant complex motion described by the piston with respect to the cylinder is sinusoidal motion. The "stroke" of the piston, as well as, the cross sectional area of the piston define the positive displacement, or "plug", volume pumped by the pump for each cycle of operation, in this case for each oscillation of movement of the piston. The piston oscillates through 360° for each pumping operation, including an intake and discharge of a plug volume. For a pump with one intake and one discharge port, the piston rotates through 360 "mechanical" degrees while oscillating through 360 "pumping" degrees.

Figure 1:
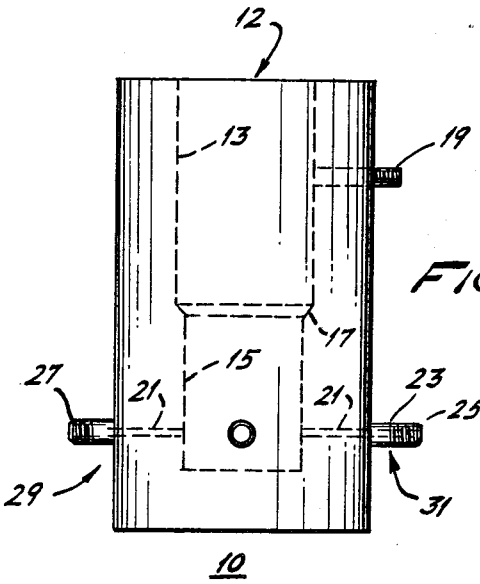
FIG. 1 is a side elevation showing the housing of the pump invention.

FIG. 1 shows a side elevation of the housing 10 of the pump of the invention. The housing 10 has a cylindrical outer surface 11 and a cylindrical cavity 12 extending from one end of the housing 10 into the housing 10 along its longitudinal axis. This cylindrical cavity 12 includes a first larger diameter opening 13, and a second, smaller diameter opening 15 further within the housing 10. These cylinder portions 13 and 15 are situated along the same concentric axis, the longitudinal axis of the cylinder 10. These openings 13, 15 form the operating cylinder 12 in which a piston assembly for the pump operates. The larger dimensioned cylinder portion 13 tapers into the smaller dimensioned cylinder portion 15 at a tapered shoulder 17. This shoulder being circular and annularly concentric about the longitudinal axis of the housing 10. A threaded screw 19 extends through a threaded opening in the sidewall of the housing 10 so that it projects beyond the cylindrical outer surface 11. The inside end of the screw 19 is capable of projecting into the larger cylinder portion 13 when it does it forms a cam for interacting with a piston assembly.

A plurality of ports extend through the cylinder wall 11 in the location of the smaller cylinder portion 15. These ports each include a drilled hole 21 through the wall of the housing 10 and a fluid carrying tube 23 having a flared seat 25 and a threaded body portion 27 for making a fluid tubing or hose coupling therewith.

Figure 2:
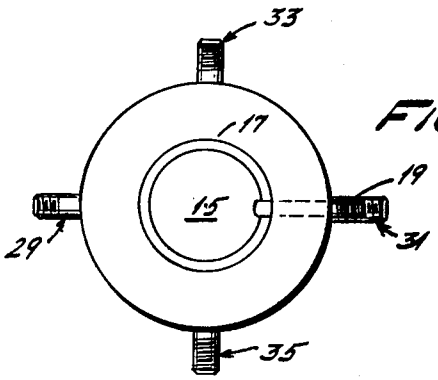
FIG. 2 is an end view of the housing of FIG. 1 showing the cylinder opening.

While an embodiment of the invention could have a housing with two ports as embodied by the coupling tubes et al 29, 31, FIGS. 1 and 2, the embodiment of the present invention has four such ports as structured by the additional coupling tubings 33, 35 and openings 21 into the smaller cylinder opening 15. As long as the piston assembly of the pump is caused to oscillate through 360 "pumping" degrees to make a complete pumping cycle as it travels between an intake port and a discharge port and back to an intake port, the second intake port can be one and the same to the first intake port (i.e. one intake port and one discharge port per pump) or it can be entirely different intake port. Any embodiment of the invention can have any even number of ports, paired into intake and discharge ports, whereby a discharge port is situated adjacent to an intake port, whether they be diametrically opposed on the outer cylinder wall 11 or not.

It is advantageous to have the port tubes 29, 35, 31, 33 positioned equal distance about the curvature of the outer cylinder 11. This allows for a regular and balanced structure which is more easily constructed as will be seen from the description below. At this point it is more appropriate to speak to the smaller cylinder portion 15 as the pumping cylinder 15 and the larger cylinder portion 13 as the cam cylinder 13.

FIG. 2 is an end view of the housing 10 showing the cylinders 13, 15 as well as the tapered shoulder 17 connecting the cam and pumping cylinders 13, 15 and showing the screw cam 19 projecting into the cam cylinder 13. Discharge ports 29, 31 and intake ports 33, 35 are also seen.

Figure 3:
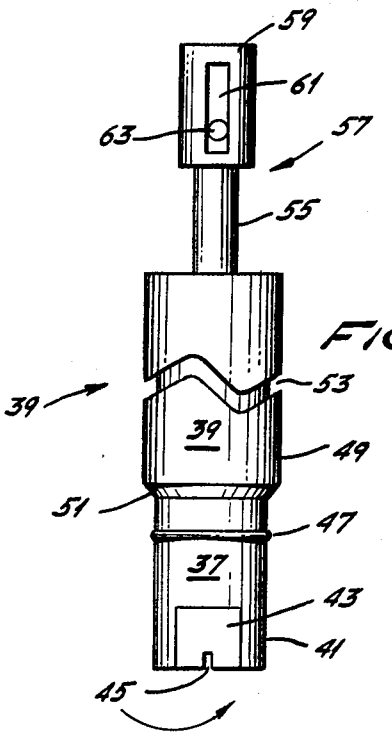
FIG. 3 is a side elevation of the piston assembly, including the piston, cam track, shaft and slip coupling for the pump.

A piston assembly 36, FIG. 3, has a piston portion 37 and a cam track portion 39. The piston portion 37 operates within the pumping cylinder 15 while the cam track portion 39 operates within the cam cylinder 13.

Cylinder portion 37, FIG. 3, includes a cylindrically shaped piston 41 having a notch 43 in the side wall thereof. This notch 43 can be of any shape but must take up less than one quarter of the circumference of the piston 41.

Notch 43 is a rectangular cavity in the side of the piston 41 and extends from the head a distance less than the piston 41 stroke. Notch 43 transcribes an arc of less than 90°. This arc angle will vary as the number ports 29, 31, 33, 35 in the housing 10. For four parts, it is less than 90°, for two ports, it is less than 180°, and for eight ports it is less than 45°. These angles, however, are for evenly spaced ports.

The present pump configuration has ports laid out as shown in FIG. 2, i.e., two pairs of intake ports 33, 35 diametrically opposed from one another and two pairs of discharge ports 29, 31, diametrically opposed from one another and being located in a 90° rotation from the intake ports 33, 35). The notch 43 will pass each of the ports 35, 31, 33, 29, in turn, and cause an intake, discharge, intake, discharge operation respectively to occur.

Figure 4:
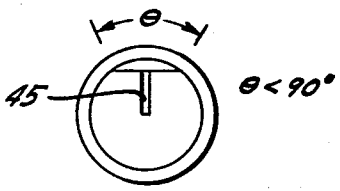
FIG. 4 is an end view of the piston of FIG. 3.

Extending toward the center of the head of the cylinder 41 from the wall of the notch 43, in the plane of the cylinder 41 head, is a small pressure relief groove 45, FIG. 4. This groove 45 allows the head to more easily seat against the head end of the pumping cylinder 15.

Returning to FIG. 3, a pressure sealing ring 47 is annularly positioned about the lower end of the piston 41 (i.e. at that end of the piston 41 which is away from the head) and held in that position by being seated in an annular groove in that piston 41 wall.

The piston 41 wall tapers into a cylindrical cam track structure 49 having a larger outside diameter than the piston 41. The cylindrical cam track structure 49 is joined to the piston 41 at a tapered shoulder 51. This tapered shoulder 51 being identical in angle to the cylinder taper shoulder 17 as it is intended to seat against that tapered shoulder 17.

A sinusoidal notch 53 extends into the wall of the cam track structure 49 and about the outer cylindrical surface thereof. The number of sinusoidal 360° pumping oscillations this cam track 53 traverses as it traverses 360 mechanical degrees about the cam track structure 49 is dependent upon the number of input and discharge ports for the pump. With the present embodiment, since there are two pairs, this cam track 53 oscillates twice (720° or two 360° sinusoidal cycles) for a complete traversal about the cam track structure 49.

A shaft 55 is securely attached to the cam track structure 49 and extends outwardly therefrom along the longitudinal axis of the piston assembly 36. This shaft 55 is intended to transfer rotational power to the piston assembly 36.

Situated at the free end of the shaft 55 is a slip coupling 57. Slip coupling 57 is of a traditional design including a coupling collar 59, for mating to a motor shaft, having a slot 61 therethrough extending longitudinally along the coupling collar 59 and along the longitudinal axis of the assembly. A pin 63 extends orthogonally out from the shaft 55 and operates within the slot 61.

The coupling 59 is intended for connecting directly to the shaft of an electric motor or other source of rotational power. The length of the slot 61 is equal to, or exceeds the peak to peak amplitude of the sine wave defined by the cam track 53. This peak to peak amplitude defines piston 41 "stroke".

Figure 5:
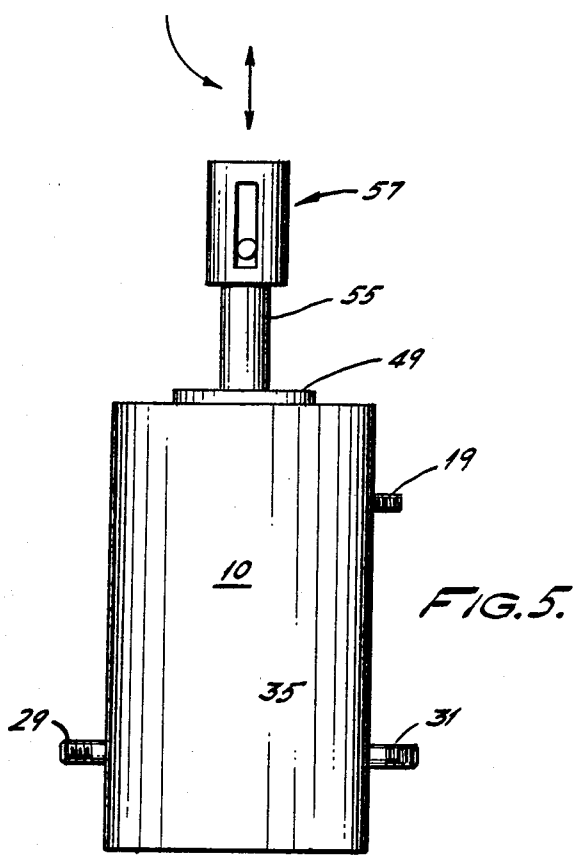
FIG. 5 is a side elevation of the assembled pump invention.

The piston assembly 36 may be inserted into the housing 10 to form the assembled structure, FIG. 5. This insertion forces a compression of the sealing ring 43 which seals the pumping cylinder 15 and the piston 41 from the cam cylinder 13 with its cam screw 19, and the cam track structure 49 with the cam track 53. During the final assembly, the screw 19 is retracted so that it will not project into the cam cylinder opening 13. Once assembled, the screw 19 is turned so that it projects, meets and mates with the cam track 53. The interaction between this cam screw 19 and the cam track 53 will cause the piston 41 to reciprocate within the cylinder portion 15 as the shaft 55 causes it to rotate continually in a single direction. The resultant motion of the cylinder 41 will be sinusoidal with respect to the pumping cylinder 15.

Viewing the pump from the piston 41 head end thereof, the piston 41 is caused when pumping, to rotate clockwise. This motion will bring the notch 43 and groove 45 in communication with the intake port 35 as the piston 41 is receding from the head of the pumping cylinder 15, and will bring the notch 43 and groove 45 in communication with the discharge port 31 as the piston 41 is approaching the head of the pumping cylinder 15. Identical movements of the piston 41 occur with respect to the intake ports 33 and discharge port 26, respectively.

The volume evacuated and then filled, i.e. the positive displacement volume created by the movement of the piston 41 defines the displacement volume or "plug" volume pumped by the pump for each stroke. This volume is a function of the cross section area of the piston, the volume lost to the notch 43 and groove 45 and the peak to peak distance of the cam track 53 sine wave, i.e. the longitudinal stroke or travel.

However, while the piston strokes in a reciprocating fashion over the "peak to peak" distance, it also rotates through a full 360° angle so that the sinusoidal resulting motion is quite obvious. This motion causes the notch 43 to turn away from a port thus sealing off that port. The clearances between the piston 41 and the pumping cylinder 15 are such that a port is sealed when the notch 43 is not communicating with it. Standard metalurgical practices allow a structure which will handle pressures in excess of 100 psi without leaking.

The invention therefore provides a rotary pump, capable of continuous rotation and being directly driven off of a rotating power source, such as an electrical motor, while transforming a portion of this rotating motion into a concurrent reciprocating movement of the piston 41 thereof to cause a resultant sinusoidal operation of this piston 41, whereby the stroke of the piston 41 defines the plug volume pumped through the pump for each stroke. A notch 43 or other cavity in the side of the piston 41 and extending from the head thereof is capable of communicating with ports for providing selective and successive valving thereto as the piston 41 rotates. The height of this notch 43 is less than piston 41 stroke.

It is the classic reciprocating motion of the piston 41, as it recedes to create a negative pressure, which causes fluid to fill the pumping cylinder 15. It is the return motion of the piston 41 head, as it moves toward the pumping cylinder head, which causes a positive pressure and pumps the fluid out of the pumping cylinder 15.

Moreover, it is the movement of the piston 41 within the pumping cylinder 15 which causes valving at the parts 29, 35, 31, 33.

The housing 10 can be constructed of many materials, including aluminum, titanium or stainless steel. It can be cast of machined. However, it is very important that the pumping cylinder 15 be machined and be absolutely true. Moreover, it is advantageous to have the surface of the pumping cylinder sintered or impregnated with a hard water resistive material such as ruby.

Likewise, the piston assembly 36 can be made of many materials, including aluminum, titanium or stainless steel. It is preferred that it be made of precisely machined parts. The cam track 53 controls the motion of the piston 41 and needs to be precisely formed. It is preferred that the cam track structure by made of materials which are sufficiently hard and wear resistant to give good service. The cam screw 19 should be of similar materials. Any number of chromium steels, cadmium steels and magnesium steels are quite suitable.

The piston 41 should have an identical surface as the pumping cylinder 15. If this cylinder 15 has a ruby surface, the piston 41 should also have a ruby surface.

Figure 6:
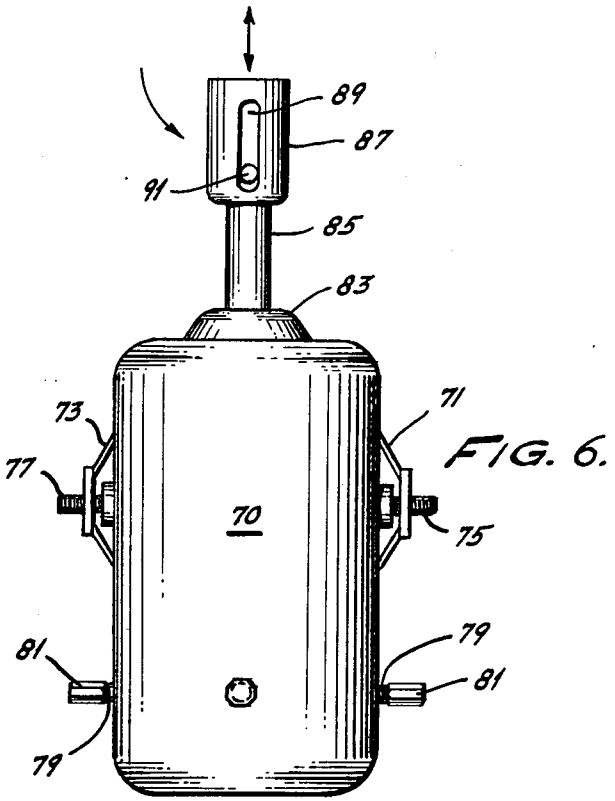
FIG. 6 is a side elevation of an alternate embodiment of the invention.

An alternate configuration for the invention is shown in FIGS. 6 through 11. The FIG. 6 shows the assembled pump assembly having a rounded cast housing portion 70 with a pair of mounting brackets 71, 73 connected thereto, having mounting bolts 75, 77, respectively, thereof.

This embodiment of the pump, like the previous embodiment, has four ports entering upon the pumping cylinder. Each port is serviced by a fluid carrying tube 79 and a threaded fitting 81 with a flared seating surface therein of a design commonly used in the plumbing and piping industry.

A cam support assembly 83 protrudes from one end of the housing 70. Connected to this cam support assembly 83 is a drive shaft 85 which has a slip coupling 87 situated on the free end thereof. Slip coupling 87 is of a standard design having a longitudinal slot 89 therein through which a drive pin 91, welded to the drive shaft 85, operates.

The housing 70, like the housing 10, has a cylinder extending longitudinally therethrough. This cylinder, FIG. 7, has a larger dimensioned cam cylinder 93 extending inwardly from the end of the housing 70 and a smaller dimensioned pumping cylinder 95 extending inwardly from the cam cylinder. These two cylinders 93, 95 taper into one another at an annularly shape tapered shoulder 98. Extending annularly about the wall of the cam cylinder 93 and in the wall thereof is a sinusoidal cam track 97.

Positioned equidistant about the side walls of the pumping cylinder 95 are four ports 99. These ports are connected to the exterior of the housing 70 via holes 101 extending through the side wall of the housing 70, and via the tubing 79 and fittings 81.

While the ports 99 may be spaced anywhere about the side wall of the pumping cylinder 95, it is more convenient to have a regular operation of the pump and therefore a balanced structure therefor. The ports 99, as with the previous embodiment, should be positioned at an equal distance from the head of the cylinder 95.

Figure 9:
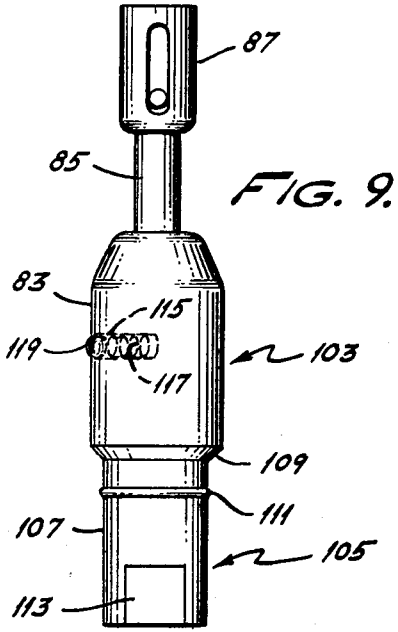
FIG. 9 is a side elevation of the piston assembly including the piston, cam track follower ball, shaft and slip coupling for the embodiment of FIG. 6.
Figure 10:
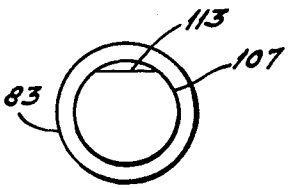
FIG. 10 is an end view of the piston of FIG. 9.

A piston assembly, 103, FIG. 9, includes a cam support assembly 83 and a piston assembly 105. The shaft 85 and associated slip coupling 87 are connected to the cam support assembly 83 at a position away from the piston assembly 105. Essentially, the cam support assembly 83 and the piston assembly 105 are cylindrically shaped and continue along the same longitudinal axis, one being an extension of the other and connected immediately thereto. The shaft 85 end of the cylindrical cam support assembly 83 may have molded or cast rounded ends. The cylindrical cam support assembly 83 tapers into a smaller dimensioned cylindrical piston 107. This tapering from the larger dimensioned cylindrical cam assembly 83 to the smaller dimensioned cylindrical piston 107 forms a tapered shoulder 109.

The tapered shoulder 109 between the cam support assembly 83 and the piston 107 has an angle identical to and is intended for mating the tapered surface between the cam cylinder 93 and the pumping cylinder 95.

An O-ring fits annularly about the bottom of the piston 107 in an annular groove thereof. A notch 113 extends from the head of the piston 107 along the side wall of the piston 107. This notch is actually the absence of a cordal portion of the piston 107. The arc transcribed by this notch 113 is less than 90° when the pump embodiment has four ports, FIG. 10. The notch 113 can be of a plurality of shapes. However, it is convenient to make it a rectangular section 113 which has been removed from the piston 107, FIG. 11. This notch 113 extends along the piston 107 a distance less than the stroke. The piston 107 has a head which runs orthogonally to the longitudinal axis of that piston. This is desirable as the head of the pumping cylinder 95 is also parted orthogonally to the longitudinal axis of that cylinder.

Figure 11:
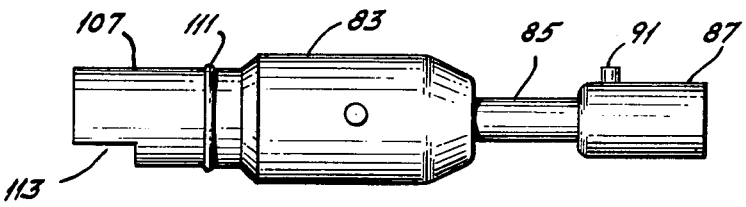
FIG. 11 is another side elevation of the piston assembly of FIG. 9 taken from a point 90° around the assembly.

A cylindrical hole 115, FIGS. 9 and 11, has been formed through the side wall of the cam support assembly 83. Residing in this hole 115 is a spring 117 connected to a cam ball 119 situated on the outward end of the spring 117.

The piston assembly 103 is inserted into the housing 70 so that the piston 107 operates within and co-acts with the pumping cylinder 95, and the cam support assembly 83 operates within and co-acts with the cam cylinder 93. In its assembled position the spring 117 forces the cam ball 119 partially into the cam track 97 so that the ball 119 holds the piston assembly within the housing 70. This spring 117 force may be overcome by inserting a very thin sleeve down between the cam support assembly 83 and the cam cylinder 93 for forcing the ball 119 back into the hole 115 so that the piston assembly 103 may be removed from the housing 70. As such, the clearances between the cam support assembly 83 outer wall and the cam cylinder 93 are not critical.

To the contrary, however, the clearances between the side walls of the piston 107 and the pumping cylinder 95 must be "neat" enough to provide a fluid seal when the notch 113 is not in direct communication with any of the ports 99. It is desirable, therefore, that the surfaces of the piston 117 and the pumping cylinder 95 be properly prepared against wearing and be of sufficient hardness. Crystal coated surfaces, i.e. rubied surfaces are quite desirable. Laser machining provides for trued surfaces.

The cam ball 119 can be an ordinary ball bearing. This ball will roll in the cam track 97 and within its retaining hole 115 thereby reducing the likelihood of wear even when compared to the design of the previous embodiment wherein the cam was the inner end of the screw 19.

Figure 8:
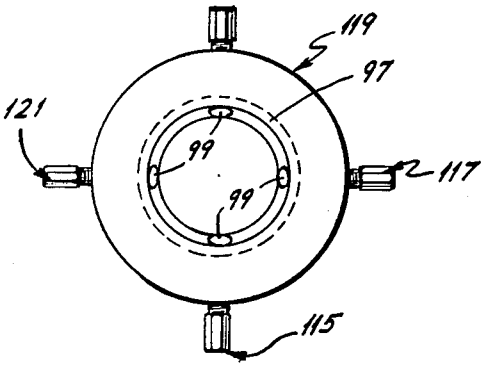
FIG. 8 is an end view of the housing of FIG. 7 showing the cylinder opening.
Figure 7:
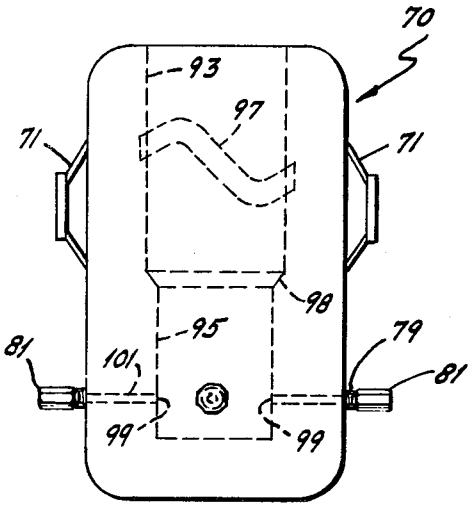
FIG. 7 is a side elevation of the housing of the embodiment of FIG. 6.

This four port pump can have its four ports 115, 117, 119, 121, FIG. 8, connected in a similar manner to four ports 35, 31, 33, 29, FIG. 2 of the previous embodiment. In this latter embodiment, the ports 115 and 119 are intake ports similar to the ports 35 and 33 of the first embodiment. Similarly, the ports 117 and 121 are discharge ports as were the ports 31 and 29 of the first embodiment.

Either embodiment of the subject invention may be connected as two separate pumps or as a single two stage pump. When connected as two separate pumps the intake 119 and the discharge 121 of the second embodiment are connected into one pumping operation while the intake 115 and the discharged 117 are connected into a second pumping operation. Two independently operating pumping operations will therefore be conducted as the piston 107 rotates and a pumping action will alternate between the two pumps thereof.

However, when the discharge 117 is connected to the input 119 the pump becomes a single two stage pump having a first stage intake 115 and a first stage discharge 117, and a second stage intake 119 with a second stage discharge 121. The first embodiment can likewise be connected in either mode of operation.

Many changes in the above described apparatus can be made without departing from the intent and scope thereof. It is intended, therefore, that all matter contained in the above description and shown in the accompanying drawings be interpreted as illustrative and not be taken in the limiting sense. Any pump which has a piston driven in rotary motion and which transforms that rotary motion into a concurrent reciprocating motion of the piston is contemplated. Also contemplated is a pump which utilizes a cam guide or track to establish the concurrent motion. A notch in the piston may be utilized to gate the ports (perform a valving operation) as well as may other means. The even numbered (pair intake-discharge) plurality of ports should be located at approximately the same distance from the end of the cylinder or chamber within which the piston operates. Neither the piston nor the chamber in which it operates, of necessity, need by cylindrical. The notch or other void should communicate each port in turn with the space between the piston and the end of the chamber. This space should change when in communication with a given port, however, to provide a positive displacement pumping operation. As the pump cylinder reciprocates as directed by the cam track, it will reciprocate that number of times per mechanical revolution thereof as there are repetitions in the cam track (repetitive 360 pumping cycles). A pump incorporating the features of the present invention is capable of plural strokes per revolution of the drive shaft thereto.

What is claimed:

1. A positive displacement valveless pump comprising:

a cylinder member having a closed head end and a plurality of ports opening through the sidewall of said cylinder, said ports being in a single radial plane and defining alternate intake and exhaust ports;

a piston member operable within said cylinder member in concurrent reciprocating and rotating motion, said piston member seating against said cylinder head at the end of a compression stroke to minimize dead volume;

a first void in the piston extending along the piston wall from the head of the piston and transversing circumferentially the piston wall a distance less than a distance between adjacent cylinder ports;

a second void, this second void extending across the piston head to the first void; and a sinusoidal cam track and cam follower operative between the cylinder wall and the piston to define the stroke length and said concurrent reciprocating and rotating motion of the piston relative to the cylinder.

2. The pump of claim 1 wherein the first void is an arcuate notch in the wall of the piston extending from the head a distance less than the stroke length so that the piston rotation alone controls porting.

3. The pump of claim 2 wherein the second void is a groove in the piston head extending from its approximate center to the arcuate notch.

4. The pump of claim 3 wherein the piston and the cylinder are each of two cylindrical sizes, the piston having a first smaller diameter portion containing the arcuate notch and the groove and a second larger diameter portion, and the cylinder having a first smaller diameter portion containing said plurality of ports and mating in sealing fashion with the piston first diameter portion and a second larger diameter portion mating with the piston second diameter portion, said sinusoidal cam track and cam follower being operative between the piston and the cylinder second diameter portions.

5. The pump of claim 4 wherein the piston first diameter portion meets the piston second diameter portion at a tapered shoulder formed in the piston wall; wherein the cylinder first diameter portion meets the piston second diameter portion at a tapered shoulder formed in the cylinder wall.

6. The pump of claim 5 wherein the piston tapered shoulder and the cylinder tapered shoulder are of similar tapers these shoulders seating against one another when the piston seats against the cylinder head.

* * * * *

UNITED STATES PATENT AND TRADEMARK OFFICE

CERTIFICATE OF CORRECTION

PATENT NO. : 4,479,759

DATED : October 30, 1984

INVENTOR(S) : Vernon Zeitz

It is certified that error appears in the above-identified patent and that said Letters Patent is hereby corrected as shown below:

Column 1, line 26 "need" should be --needs--

Column 4, line 51 "parts" should be --ports--

Column 5, line 67 "port 26" should be --port 29--

Column 6, line 42 "parts" should be --ports--

Column 6, line 45 "of" should be --or--

Column 6, line 49 "hard water" should be--hardwear--

Column 6, line 55 "by" should be --be--

Signed and Sealed this

*Seventh* Day of *May 1985*

[SEAL]

*Attest:*

DONALD J. QUIGG

*Attesting Officer* *Acting Commissioner of Patents and Trademarks*